US010107557B2

(12) United States Patent
Lan

(10) Patent No.: US 10,107,557 B2
(45) Date of Patent: Oct. 23, 2018

(54) INTEGRATED HEAT DISSIPATION DEVICE

(71) Applicant: ASIA VITAL COMPONENTS CO., LTD., New Taipei (TW)

(72) Inventor: Wen-Ji Lan, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 57 days.

(21) Appl. No.: 15/166,282

(22) Filed: May 27, 2016

(65) Prior Publication Data

US 2017/0343295 A1 Nov. 30, 2017

(51) Int. Cl.

| | |
|---|---|
| ***F28D 15/04*** | (2006.01) |
| ***F28D 15/02*** | (2006.01) |
| ***F28F 9/013*** | (2006.01) |
| *F28D 21/00* | (2006.01) |

(52) U.S. Cl.

CPC ..... *F28D 15/0266* (2013.01); *F28D 15/0233* (2013.01); *F28D 15/04* (2013.01); *F28F 9/013* (2013.01); *F28D 2021/0028* (2013.01)

(58) Field of Classification Search

CPC .. F28D 15/04; F28D 15/0266; F28D 15/0233; F28D 15/046; F28D 15/275; F28D 15/0275; F28D 2021/0028; F28F 9/013

USPC ..... 165/104.26, 104.22, 104.13

See application file for complete search history.

(56) References Cited

U.S. PATENT DOCUMENTS

| | | | | |
|---|---|---|---|---|
| 4,467,861 | A * | 8/1984 | Kiseev | F28D 15/043 165/104.22 |
| 5,899,265 | A * | 5/1999 | Schneider | F28D 15/0275 165/104.13 |
| 8,176,973 | B2 * | 5/2012 | Liao | F28D 15/046 165/104.26 |
| 2006/0283577 | A1 * | 12/2006 | Liu | F28D 15/043 165/104.26 |
| 2007/0199682 | A1 * | 8/2007 | Hwang | F28D 15/046 165/104.26 |
| 2008/0121387 | A1 * | 5/2008 | Taniguchi | F28D 1/05333 165/175 |
| 2009/0242174 | A1 * | 10/2009 | McCutchen | F28D 15/0233 165/104.25 |
| 2013/0233014 | A1 * | 9/2013 | Agostini | F28D 15/0266 62/515 |
| 2013/0292092 | A1 * | 11/2013 | Omori | F28F 3/00 165/104.11 |
| 2014/0144169 | A1 * | 5/2014 | Inaba | G06F 1/20 62/259.2 |
| 2014/0182819 | A1 * | 7/2014 | Yang | F28D 15/02 165/104.26 |

(Continued)

*Primary Examiner* — Raheena R Malik
(74) *Attorney, Agent, or Firm* — Jackson IPG PLLC; Demian K. Jackson

(57) ABSTRACT

An integrated heat dissipation device includes at least one first case, a second case and multiple third cases. The first and second cases respectively have a first case chamber and a second case chamber. Each third case has a third case chamber. Each third case is connected to the second case via a first heat pipe. The first case is connected to the corresponding third case via a second heat pipe passing through the second case. Accordingly, the working fluid in the third case chambers can flow through the respectively connected first and second heat pipes to the first and second case chambers to achieve the vapor-liquid circulation effect and dissipate the heat.

20 Claims, 17 Drawing Sheets

(56) References Cited

U.S. PATENT DOCUMENTS

2016/0128234 A1* 5/2016 Uesugi ..... H05K 7/20336
361/700

* cited by examiner

INTEGRATED HEAT DISSIPATION DEVICE

BACKGROUND OF THE INVENTION

1. Field of the Invention

The present invention relates generally to an integrated heat dissipation device, and more particularly to an integrated heat dissipation device having higher heat dissipation efficiency.

2. Description of the Related Art

Currently, it is a trend to manufacture lighter and thinner electronic apparatus. Therefore, the respective components of the electronic apparatus are more and more minified. However, along with the miniaturization of the size of the electronic apparatus, the heat generated by the electronic components has become a major obstacle to improvement of the performance of the electronic apparatus and system. Therefore, in order to effectively solve the heat dissipation problem of the components in the electronic apparatus, many manufacturers in this field have provided various vapor chambers and heat pipes with better heat conduction performance so as to effectively solve the heat dissipation problem at the current stage.

The vapor chamber is a rectangular case (or plate body). The case has an internal chamber. A capillary structure is disposed on inner wall face of the chamber. A working fluid is filled in the case. One side of the case (the evaporation section) is attached to a heat generation component (such as a CPU, a Southbridge/Northbridge chip set, a transistor, an MCU or any other electronic component) for absorbing the heat generated by the heat generation component. The liquid working fluid in the evaporation section of the case will evaporate and convert into vapor working fluid. The heat is transferred to the condensation section of the case. In the condensation section, the vapor working fluid is cooled and condensed into liquid working fluid. The liquid working fluid then flows back to the evaporation section under gravity or capillary attraction of the capillary structure to continue the vapor-liquid circulation so as to achieve the heat spreading and dissipation effect.

The working principle and theoretic structure of the heat pipe are identical to those of the vapor chamber. Basically, metal powder is filled in the interior of the circular heat pipe. (Alternatively, a capillary structure of woven mesh or grooved structure or a complex capillary structure is disposed in the interior of the heat pipe). By means of sintering, an annular capillary structure is formed on the inner wall face of the heat pipe. Then, the heat pipe is vacuumed and a working fluid is filled into the heat pipe.

Finally, the heat pipe is sealed to form the heat pipe structure. After the liquid working fluid in the evaporation section absorbs heat, the liquid working fluid will evaporate into vapor working fluid to spread to the condensation end. When the vapor working fluid spreads to the condensation end, the vapor working fluid is gradually cooled and condensed to convert into liquid working fluid. The liquid working fluid then flows back to the evaporation section through the capillary structure.

In comparison with the heat pipe, the vapor chamber transfers the heat only in a different manner. The vapor chamber transfers the heat in a two-dimensional manner, that is, a face-to-face manner (mainly with large-area heat spreading effect). The heat pipe transfers the heat in a one-dimensional manner (mainly for remote-end heat conduction).

Accordingly, with respect to the current electronic component, one single type of heat dissipation component such as the heat pipe or the vapor chamber can hardly meet the heat dissipation requirement. In the case that the heat pipe and the vapor chamber are integrated and co-used to provide both heat spreading effect and remote-end heat conduction or dissipation effect, the heat dissipation efficiency will be greatly increased to effectively solve the heat dissipation problem of the high-power electronic components.

SUMMARY OF THE INVENTION

It is therefore a primary object of the present invention to provide an integrated heat dissipation device including at least one first case, a second case and multiple third cases. The second case is connected to the third cases via multiple first heat pipes. The first case is connected to the corresponding third case via at least one second heat pipe passing through the second case. Accordingly, the working fluid in the third cases can respectively flow through the connected first heat pipes to the second case to dissipate the heat and flow through the second heat pipe to the first case to dissipate the heat.

It is a further object of the present invention to provide the above integrated heat dissipation device, in which the first case is positioned above the second case and the second case is positioned above the third cases. The third cases are respectively connected under the second case via the first heat pipes and connected under the first case via the second heat pipes. After the working fluid in the third cases absorbs the heat and evaporates into vapor working fluid, the vapor working fluid flows through the first and second heat pipes into the second case and the first case to dissipate the heat. Thereafter, the liquid working fluid will flow from the first and second cases back to the third cases under gravity and the capillary attraction.

It is still a further object of the present invention to provide the above integrated heat dissipation device, which has better heat dissipation efficiency.

It is still a further object of the present invention to provide the above integrated heat dissipation device, which has larger heat dissipation area.

It is still a further object of the present invention to provide the above integrated heat dissipation device, in which the first tubular wall has a first inner surface facing the first heat pipe passage. The first inner surface is formed with multiple first ribs and multiple first channels. The second tubular wall has a second inner surface facing the second heat pipe passage. The second inner surface is formed with multiple second ribs and multiple second channels. The first and second heat pipe capillary structures are respectively formed on the first and second ribs and the first and second channels to increase the area of the heat pipe capillary structures and enhance the capillary passages in the heat pipe passages.

To achieve the above and other objects, the integrated heat dissipation device of the present invention includes at least one first case, a second case, multiple third cases, multiple first heat pipes and at least one second heat pipe. The first case defines a first case chamber. The first case has at least one first perforation in communication with the first case chamber. A first case capillary structure is disposed in the first case chamber. The first case chamber has an inner top side spaced from and opposite to the first perforation. The second case defines a second case chamber. The second case has at least one second perforation and multiple third perforations in communication with the second case chamber. A second case capillary structure is disposed in the second case chamber. Each third case defines a third case chamber. The third case has at least one fourth perforation in communication with the third case chamber. A working fluid is filled in the third case chamber. A third case capillary structure is disposed in the third case chamber. The third case chamber has an inner bottom side spaced from and opposite to the fourth perforation. Each third case is connected to the second case via one first heat pipe. Each first heat pipe has a first heat pipe passage. Two ends of the first heat pipe are respectively inserted in the corresponding third and fourth perforations. The first heat pipe passage communicates with the second and third case chambers. A first heat pipe capillary structure is disposed in the first heat pipe passage in connection with the second and third case capillary structures. The second heat pipe has a second heat pipe passage. One end of the second heat pipe is inserted in the corresponding first perforation. The other end of the second heat pipe is passed through the first heat pipe passage and the corresponding second perforation into the corresponding third case chamber. The second heat pipe passage communicates with the first case chamber and the corresponding third case chamber. A second heat pipe capillary structure is disposed in the second heat pipe passage in connection with the first case capillary structure and the corresponding third case capillary structure.

In the above integrated heat dissipation device, the first case has a first outer top face defining a heat dissipation area and the second case has a second outer top face defining a heat dissipation area. Each third case has a third outer bottom face defining a heat absorption area. The heat dissipation area of the first case is larger than or equal to the heat absorption area of any third case. The heat dissipation area of the second case is larger than the heat absorption area of any third case. Therefore, the heat dissipation area is increased to effectively enhance the heat exchange efficiency.

In the above integrated heat dissipation device, the first case has a first outer top face defining a heat dissipation area and the second case has a second outer top face defining a heat dissipation area. Each third case has a third outer bottom face defining a heat absorption area. The heat dissipation area of the second case is larger than the total of the heat absorption areas of the third cases.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
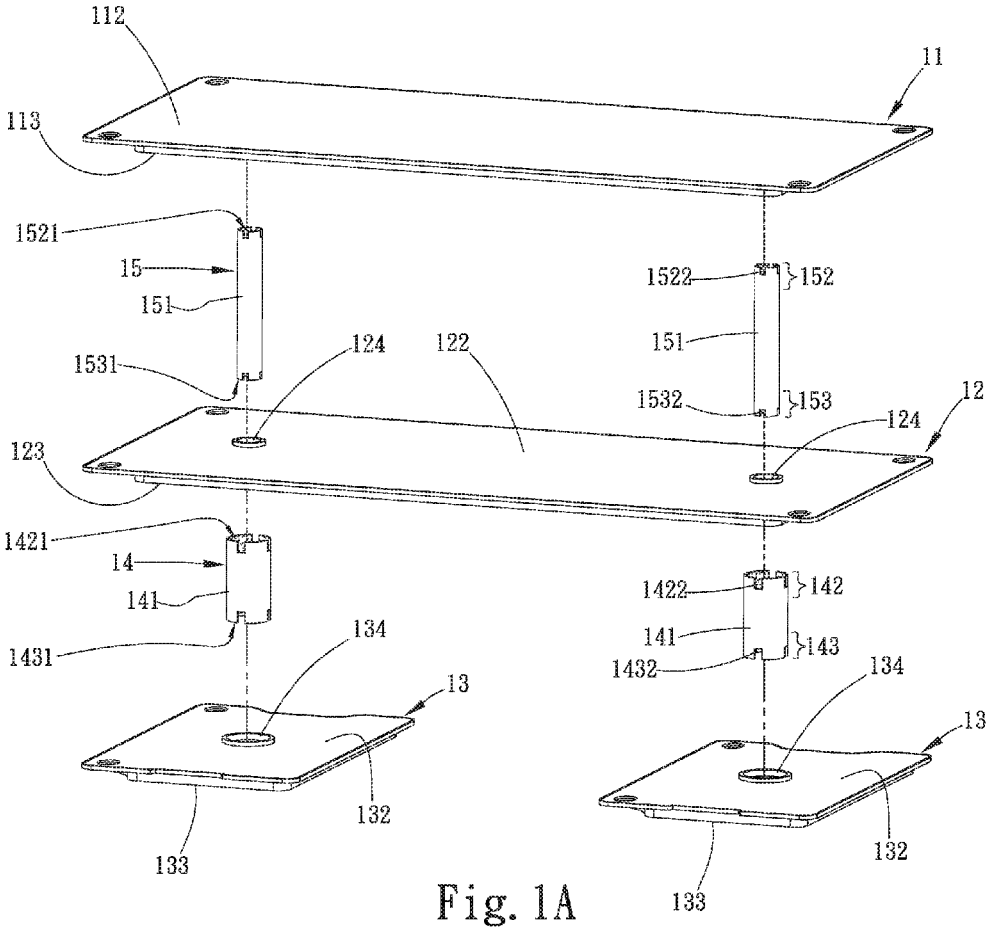
FIG. 1A is a perspective exploded view of a first embodiment of the present invention.
Figure 1B:
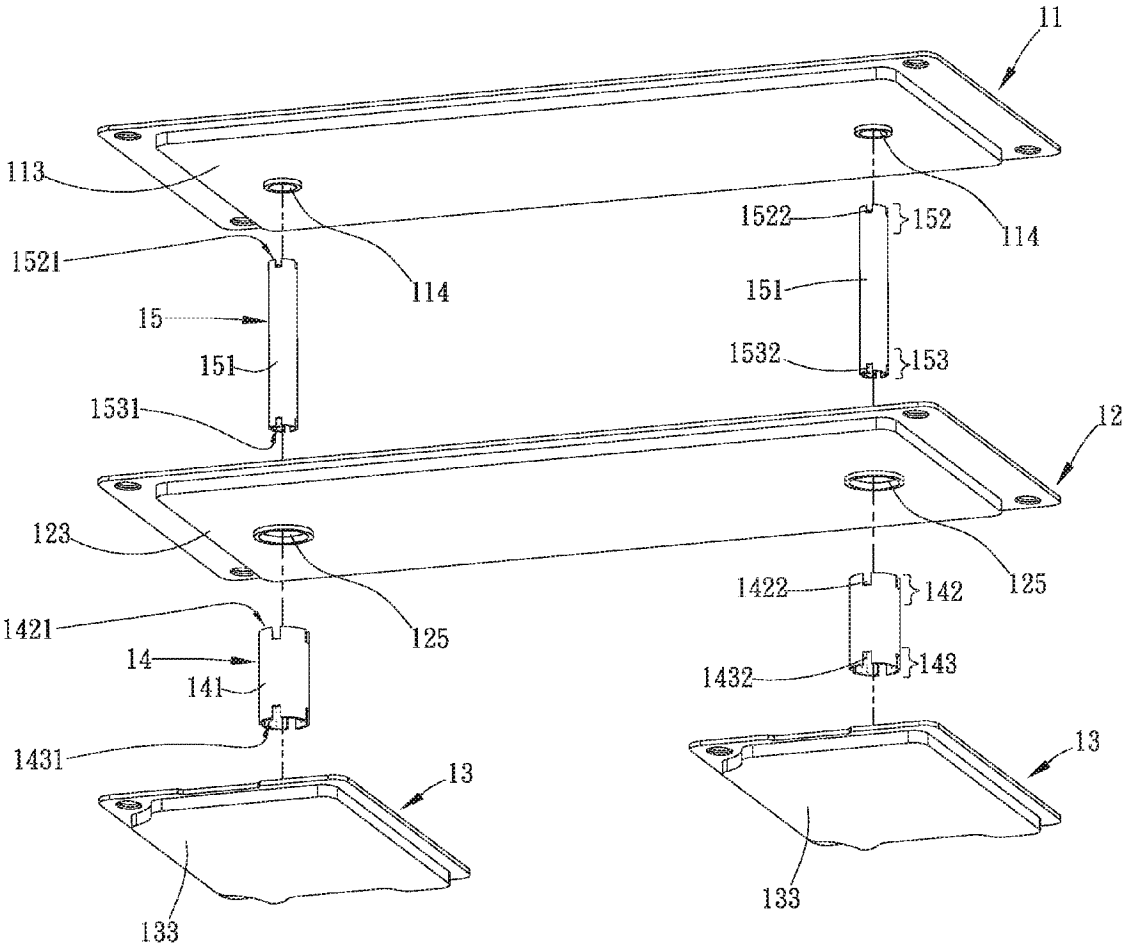
FIG. 1B is a perspective exploded view of the first embodiment of the present invention, seen from another angle.
Figure 2:
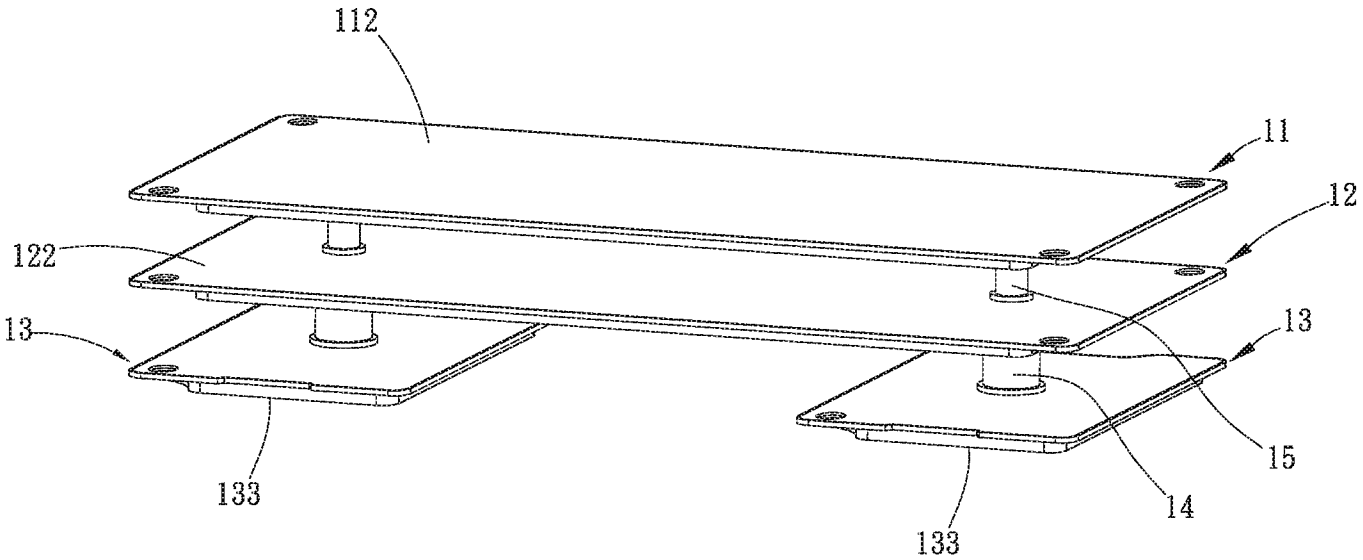
FIG. 2 is a perspective assembled view of the first embodiment of the present invention.
Figure 5:
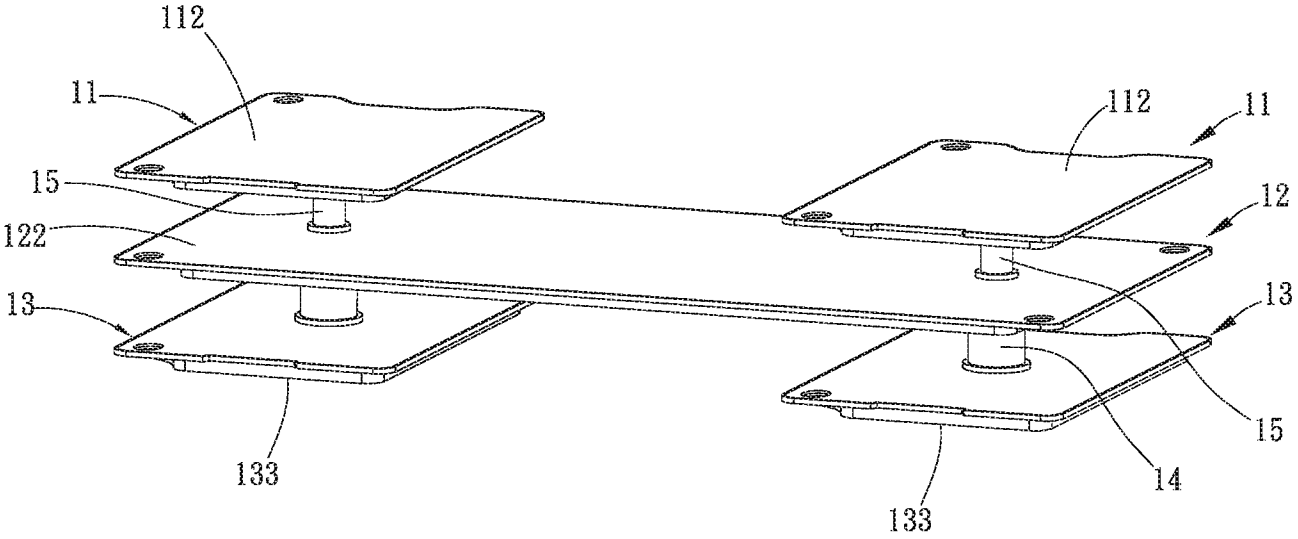
FIG. 5 is a perspective assembled view of another aspect of the first embodiment of the present invention.

Please refer to FIGS. 1A, 1B and 2. FIG. 1A is a perspective exploded view of a first embodiment of the present invention. FIG. 1B is a perspective exploded view of the first embodiment of the present invention, seen from another angle. FIG. 2 is a perspective assembled view of the first embodiment of the present invention. Also supplementally referring to FIG. 3, according to a first embodiment, the integrated heat dissipation device of the present invention includes at least one first case 11, a second case 12, multiple third cases 13, multiple first heat pipes 14 and at least one second heat pipe 15. In this embodiment, there is one single first case 11. The first case 11 is positioned above the second case 12. In this embodiment, there are two third cases 13. The third cases 13 are positioned below the second case 12 and arranged left and right. Preferably, the first, second and third cases 11, 12, 13 are made of metal material with good heat conductivity, such as gold, silver, copper or an alloy thereof. In practice, the first, second and third cases 11, 12, 13 are vapor chambers or flat-plate heat pipes. In a modified embodiment, the number of the first case 11 is not limited to one. Alternatively, there can be more than two independent first cases 11 as shown in FIG. 5. Two first cases 11 are positioned above the second case 12 in alignment with the two third cases 13 with the second case 12 positioned between the first and second cases 11, 13. The two first cases 11 are respectively connected to the two corresponding third cases 13 via two second heat pipes 15 passing through the second case 12.

The first case 11 has a first case chamber 111, a first outer bottom face 113, a first outer top face 112 and at least one first perforation 114. In this embodiment, there are two first perforations 114. The first perforations 114 are formed through the first outer bottom face 113 of the first case 11 in communication with the first case chamber 111. A first case capillary structure 115 and an inner top side 1111 are disposed in the first case chamber 111. The first case capillary structure 115 is disposed on inner wall face of the first case chamber 111. The inner top side 1111 of the first case chamber 111 is oppositely spaced from the first perforations 114. The first outer top face 112 serves to dissipate the heat and defines a heat dissipation area. The heat dissipation area of the first case 11 is the surface area of the first outer top face 112. For example, as shown in the drawings, the first outer top face 112 is rectangular and the surface area of the first outer top face 112 is the length× width thereof. In a modified embodiment, the first outer top face 112 is circular and the surface area of the first outer top face 112 is the square of radius of the first outer top face 112×3.14.

The second case 12 has a second case chamber 121, a second outer bottom face 123, a second outer top face 122, at least one second perforation 124 and multiple third perforations 125. The second outer top face 122 faces the first outer bottom face 113 of the first case 11. In this embodiment, there are two second perforations 124. The second perforations 124 are formed through the second outer top face 122 of the second case 12 in communication with the second case chamber 121. The third perforations 125 are formed through the second outer bottom face 123 of the second case 12 in communication with the second case chamber 121. A second case capillary structure 126 is disposed in the second case chamber 121. The second case capillary structure 126 is disposed on inner wall face of the second case chamber 121. The second outer top face 122 serves to dissipate the heat and defines a heat dissipation area. The heat dissipation area of the second case 12 is the surface area of the second outer top face 122. For example, as shown in the drawings, the second outer top face 122 is rectangular and the surface area of the second outer top face 122 is the length×width thereof. In a modified embodiment, the second outer top face 122 is circular and the surface area of the second outer top face 122 is the square of radius of the second outer top face 122×3.14. The diameter of the second perforations 124 is equal to the diameter of the corresponding first perforations 114. The diameter of the second perforations 124 is smaller than the diameter of the third perforations 125.

Each third case 13 has a third case chamber 131, a third outer bottom face 133, a third outer top face 132 and at least one fourth perforation 134. The third outer top face 132 faces the second outer bottom face 123 of the second case 12. The fourth perforations 134 are formed through the third outer top face 13 in communication with the third case chamber 131. A working fluid 135 (such as pure water, alcohol group or ketone group) is contained in the third case chamber 131. A third case capillary structure 136 is disposed on inner wall face of the third case chamber 131. In addition, the third case chamber 131 has an inner bottom side 1311 oppositely spaced from the fourth perforations 134. Each third case 13 is connected to the second case 12 via one of the first heat pipes 14, whereby the third case chambers 131 respectively communicate with the second case chamber 121 via the first heat pipes 14 connected between the third cases 13 and the second case 12. As shown in the drawings, the third outer bottom face 133 is a downward protruding surface for absorbing heat. The third outer bottom face 133 defines a heat absorption area. The heat absorption area is the surface area of the third outer bottom face 133. For example, as shown in the drawings, the third outer bottom face 133 is rectangular and the surface area of the third outer bottom face 133 is the length×width thereof. In a modified embodiment, the third outer bottom face 133 is circular and the surface area of the third outer bottom face 133 is the square of radius of the third outer bottom face 133×3.14. The diameter of the fourth perforations 134 is equal to the diameter of the corresponding third perforations 125. The diameter of the fourth perforations 134 is larger than the diameter of the first and second perforations 114, 124.

In a preferred embodiment, the heat dissipation area of the first case 11 is larger than or equal to the heat absorption area of any of the third cases 13. The heat dissipation area of the second case 12 is larger than the heat absorption area of any of the third cases 13. In another embodiment, the heat dissipation area of the second case 12 is larger than the total of the heat absorption areas of the third cases 13.

Each first heat pipe 14 has a first tubular wall 141, a first extension section 142 forming a first open end 1421 and a second extension section 143 forming a second open end 1431. The first tubular wall 141 has an internal first heat pipe passage 144. A first heat pipe capillary structure 145 is disposed in the first heat pipe passage 144 between the first open end 1421 and the second open end 1431. The first and second open ends 1421, 1431 are respectively positioned at two ends (the front end and rear end) of the first heat pipe 14. The two ends of the first heat pipe 14 are respectively inserted in the corresponding third perforation 125 of the second case 12 and the fourth perforation 134 of the third case 13. In other words, the first extension section 142 of the first heat pipe 14 extends through the corresponding third perforation 125 into the second case chamber 121, whereby the first open end 1421 abuts against an inner top side 1211 of the second case chamber 121. Moreover, the first heat pipe capillary structure 145 of the first open end 1421 is in connection and contact with the second case capillary structure 126 on the inner top side 1211 in the second case chamber 121.

In addition, the second extension section 143 of the first heat pipe 14 extends through the corresponding fourth perforation 134 into the third case chamber 131, whereby the second open end 1431 abuts against the inner bottom side 1311 of the third case chamber 131. Moreover, the first heat pipe capillary structure 145 of the second open end 1431 is in connection and contact with the third case capillary structure 136 on the inner bottom side 1311 in the third case chamber 131. The first and second extension sections 142, 143 of the first heat pipe 14 are respectively formed with first notches 1422 and second notches 1432 passing through the first tubular wall 141. The first heat pipe passage 144 communicates with the second case chamber 121 and the third case chamber 131 via the first and second notches 1422, 1432.

Figure 3:
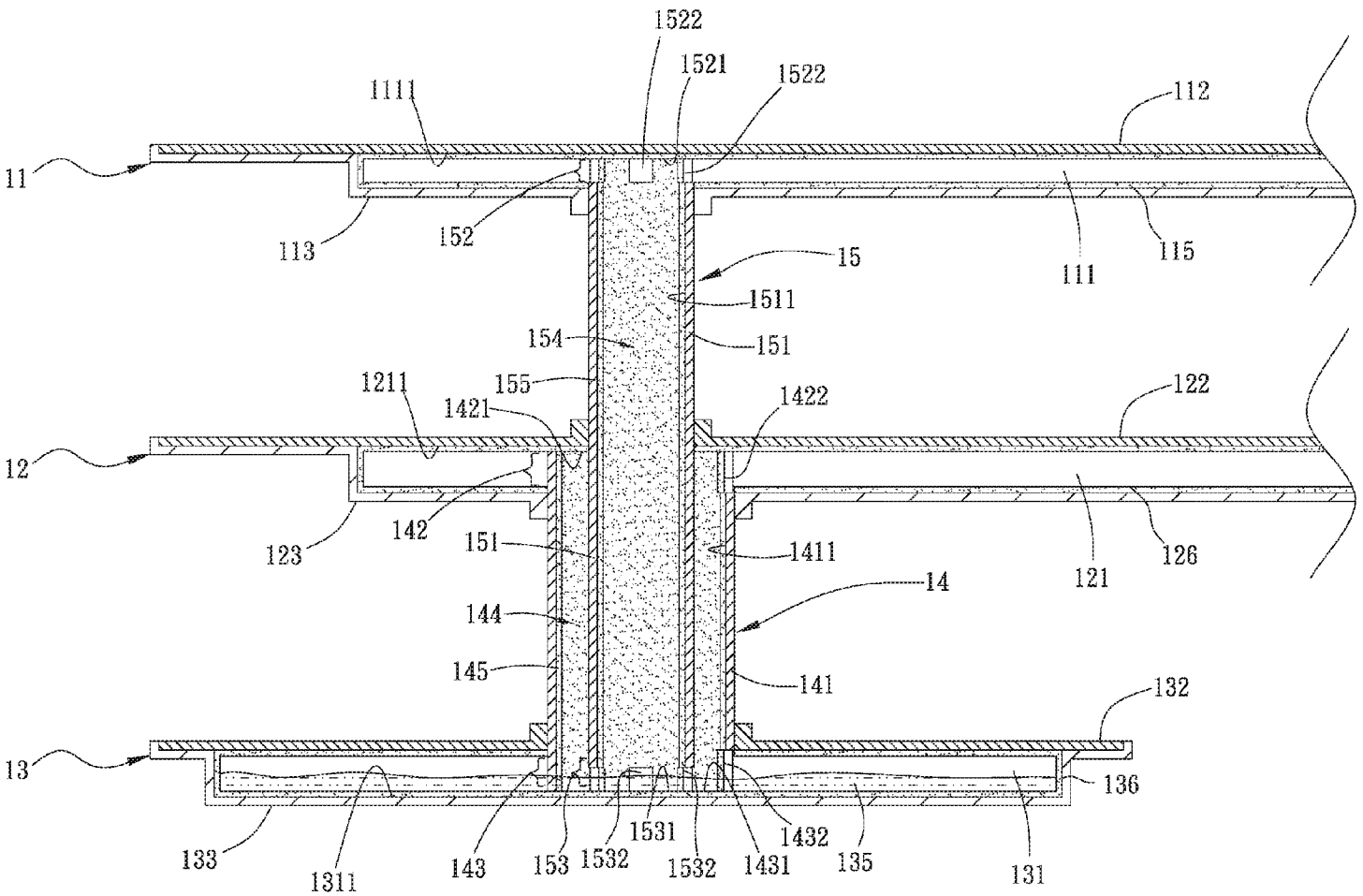
FIG. 3 is a partially sectional view of the first embodiment of the present invention.
Figure 4A:
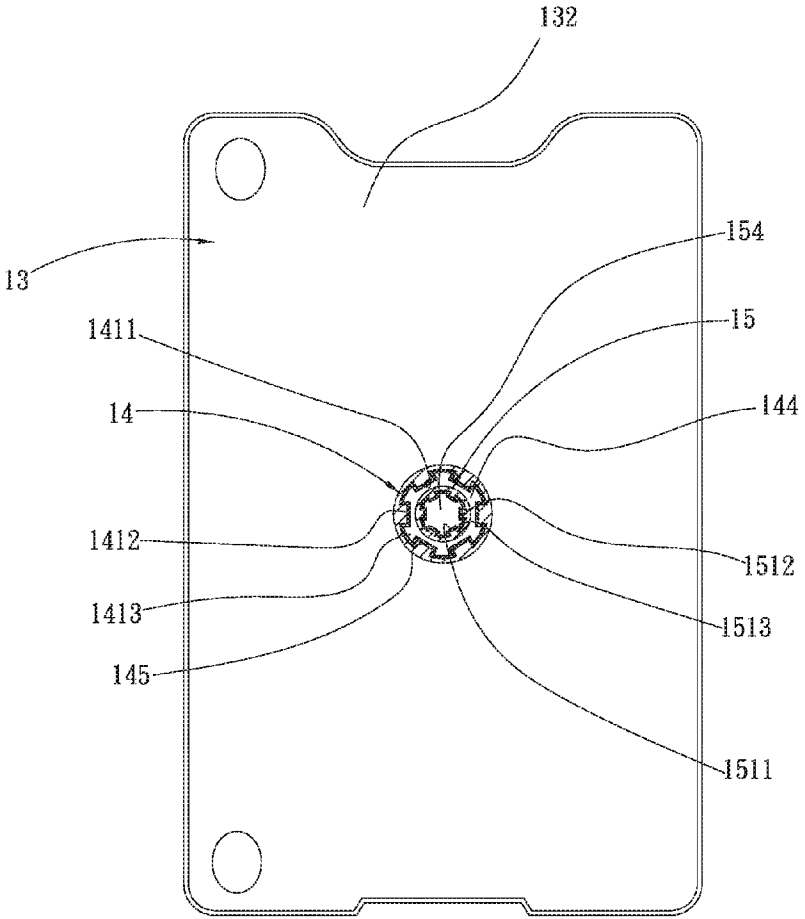
FIG. 4A is a partially top view of the first embodiment of the present invention, showing another aspect of the first and second heat pipes of the first embodiment.
Figure 4B:
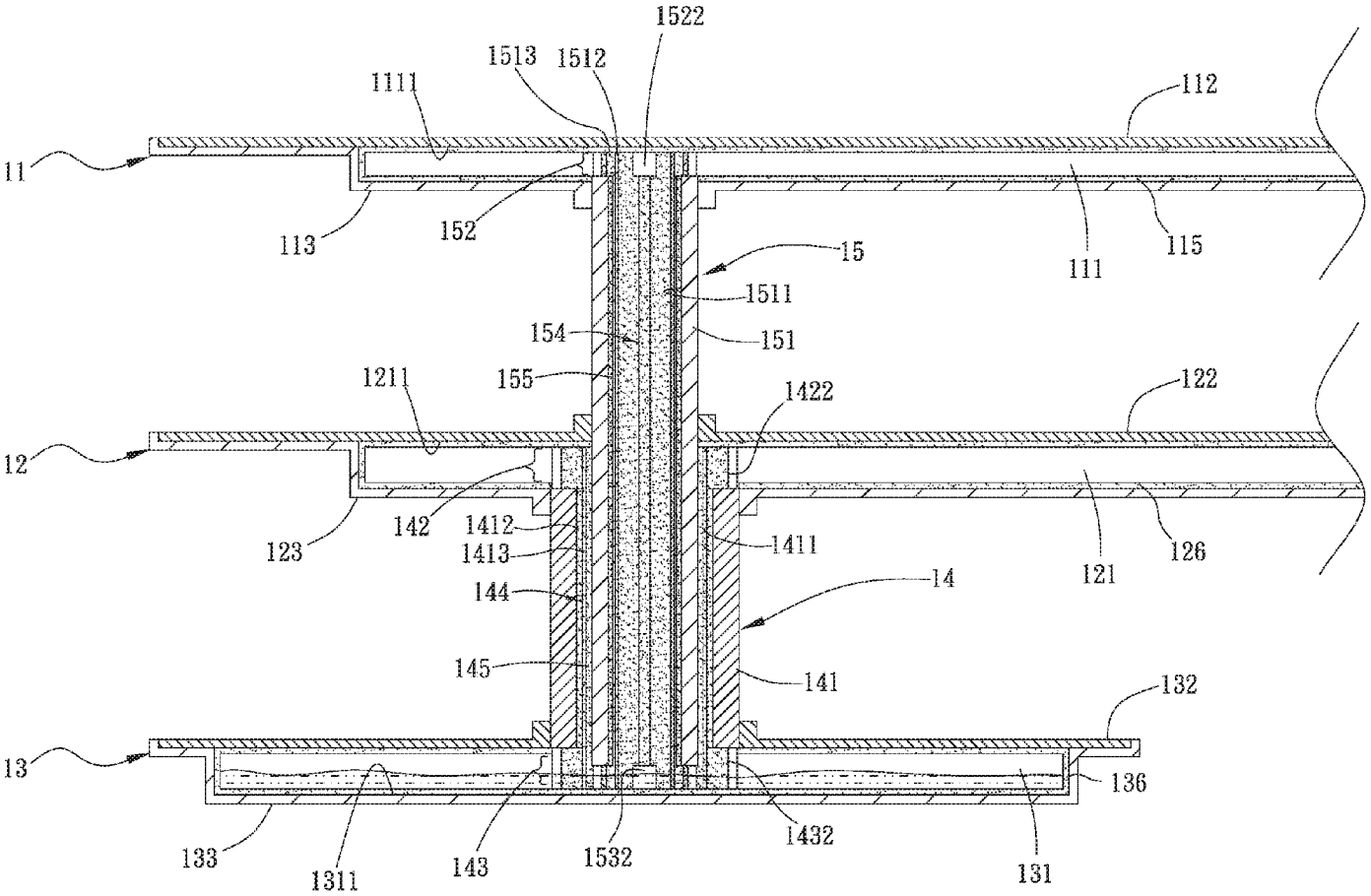
FIG. 4B is a partially sectional view of the first embodiment of the present invention, showing the other aspect of the first and second heat pipes of the first embodiment.

In a preferred embodiment, as shown in FIG. 3, the first tubular wall 141 of the first heat pipe 14 has a first inner surface 1411 facing the first heat pipe passage 144. The first inner surface 1411 is a smooth inner annular face. The first heat pipe capillary structure 145 is disposed on the first inner surface 1411. In a modified embodiment as shown in FIGS. 4A and 4B, the first inner surface 1411 is formed with multiple first ribs 1412 arranged at intervals. Each two adjacent first ribs 1412 define therebetween a first channel 1413. The first ribs 1412 and the first channels 1413 are alternately arranged and extend in a lengthwise direction of the first heat pipe 14. The first heat pipe capillary structure 145 is formed on the first ribs 1412 and the first channels 1413 to enlarge the area of the first heat pipe capillary structure 145.

In this embodiment, there are two second heat pipes 15. One end of each second heat pipe 15 is connected to the first case 11, while the other end of the second heat pipe 15 is passed through the second case 12 and the corresponding first heat pipe passage 144 to extend into the third case chamber 131 and connect with the third case 13. Each second heat pipe 15 has a second tubular wall 151, a third extension section 152 forming a third open end 1521 and a fourth extension section 153 forming a fourth open end 1531. The second tubular wall 151 has an internal second heat pipe passage 154. A second heat pipe capillary structure 155 is disposed in the second heat pipe passage 154 between the third open end 1521 and the fourth open end 1531. The third and fourth open ends 1521, 1531 are respectively positioned at two ends (the front end and rear end) of the second heat pipe 15. One end of each second heat pipe 15 is inserted in the corresponding first perforation 114 of the first case 11, while the other end of the second heat pipe 15 is passed through the second perforation 124 of the second case 12 and the corresponding first heat pipe passage 144 to extend into the third case chamber 131. In other words, the third extension section 152 of the second heat pipe 15 extends through the corresponding first perforation 114 into the first case chamber 111, whereby the third open end 1521 abuts against the inner top side 1111 of the first case chamber 111. Moreover, the second heat pipe capillary structure 155 of the third open end 1521 is in connection and contact with the first case capillary structure 115 on the inner top side 1111 in the first case chamber 111.

In addition, the fourth extension section 153 of each second heat pipe 15 extends through the corresponding second perforation 124 and the first heat pipe passage 144 into the third case chamber 131, whereby the fourth open end 1531 abuts against the inner bottom side 1311 of the third case chamber 131. Moreover, the second heat pipe capillary structure 155 of the fourth open end 1451 is in connection and contact with the third case capillary structure 136 on the inner bottom side 1311 in the third case chamber 131. The third and fourth extension sections 152, 153 of the second heat pipe 15 are respectively formed with third notches 1522 and fourth notches 1532 passing through the second tubular wall 151. The second heat pipe passage 154 communicates with the first case chamber 111 and the third case chamber 131 via the third and fourth notches 1522, 1532.

Furthermore, the two ends of the first heat pipe 14 respectively abut against the inner top side 1211 of the second case 12 and the inner bottom side 1311 of the third case 13. The two ends of the second heat pipe 15 respectively abut against the inner top side 1111 of the first case 11 and the inner bottom side 1311 of the third case 13. Accordingly, the first and second heat pipes 14, 15 can support the first, second and third case chambers 111, 121, 131 instead of the support structure in the conventional vapor chamber so as to save cost. Moreover, in this embodiment, there is only one first case 11 above the second case 12. However, the number of the first cases 11 is not limited to this. In a modified embodiment, there are multiple layers of first cases 11 above the second case 12. That is, there are multiple layers of first cases 11 are arranged at intervals above the above second case 12 by means of the second heat pipe 15. For example, two layers of first cases 11 can be disposed above the second case 12. A second heat pipe 15 (such as a first second heat pipe 15) is connected with the first layer of first case 11 above the second case 12 and passed through the second case 12 and the first heat pipe passage 144 to abut against the inner bottom side 1311 of the third case chamber 131. Another second heat pipe 15 (such as a second second heat pipe 15) is connected with the second layer (top layer) of first case 11 and passed through the first layer of first case 11 below and the second heat pipe passage 154 of a second heat pipe 15 (such as a first second heat pipe 15) to abut against the inner bottom side 1311 of the third case chamber 131.

In a preferred embodiment, as shown in FIG. 3, the second tubular wall 151 of the second heat pipe 15 has a second inner surface 1511 facing the second heat pipe passage 154. The second inner surface 1511 is a smooth inner annular face. The second heat pipe capillary structure 155 is disposed on the second inner surface 1511. In a modified embodiment as shown in FIGS. 4A and 4B, the second inner surface 1511 is formed with multiple second ribs 1512 arranged at intervals. Each two adjacent second ribs 1512 define therebetween a second channel 1513. The second ribs 1512 and the second channels 1513 are alternately arranged and extend in a lengthwise direction of the second heat pipe 15. The second heat pipe capillary structure 155 is formed on the second ribs 1512 and the second channels 1513 to enlarge the area of the second heat pipe capillary structure 155.

The first, second and third case capillary structures 115, 126, 136 and the first and second heat pipe capillary structures 145, 155 are selected from a group consisting of sintered metal powder bodies, mesh woven bodies, grooved bodies and bundled fiber bodies. These capillary structures are porous structures capable of providing capillary attraction for driving the working fluid 135 to flow. The diameter (or cross-sectional area) of each first heat pipe 14 is larger than the diameter (or cross-sectional area) of each second heat pipe 15.

According to the above arrangement, when the third outer bottom face 133 of each third case 13 is in contact with a heat source (such as a CPU, an MCU or a GPU), the heat of the heat source is transferred through the third outer bottom face 133 into the third case chamber 131. The working fluid 135 in the third case chamber 131 absorbs the heat and converts/evaporates into vapor working fluid 135. The vapor working fluid 135 will partially flow through the first heat pipe passage 144 and flow from the first notches 1422 into the second case chamber 121. The vapor working fluid 135 will condense and convert into liquid working fluid 135 in the second case chamber 121. Then, the liquid working fluid 135 on the second case capillary structure 126 in the second case chamber 121 will flow back to the second open end 1431 via the capillary attraction of the first heat pipe capillary structure 145 of the first open end 1421 and gravity. Then, due to the connection and contact between the first heat pipe capillary structure 145 and the third case capillary structure 136, the liquid working fluid 135 will flow back into the third case chamber 131. The other part of the vapor working fluid 135 will flow through the second heat pipe passage 154 and flows from the third notches 1522 into the first case chamber 111. This part of vapor working fluid 135 will condense and convert into liquid working fluid 135 in the first case chamber 111. Then, the liquid working fluid 135 on the first case capillary structure 115 in the first case chamber 111 will flow back to the fourth open end 1531 via the capillary attraction of the second heat pipe capillary structure 155 of the third open end 1521 and gravity. Then, due to the connection and contact between the second heat pipe capillary structure 155 and the third case capillary structure 136, the liquid working fluid 135 will flow back into the third case chamber 131 to continue the vapor-liquid circulation and achieve best heat dissipation efficiency.

Figure 6:
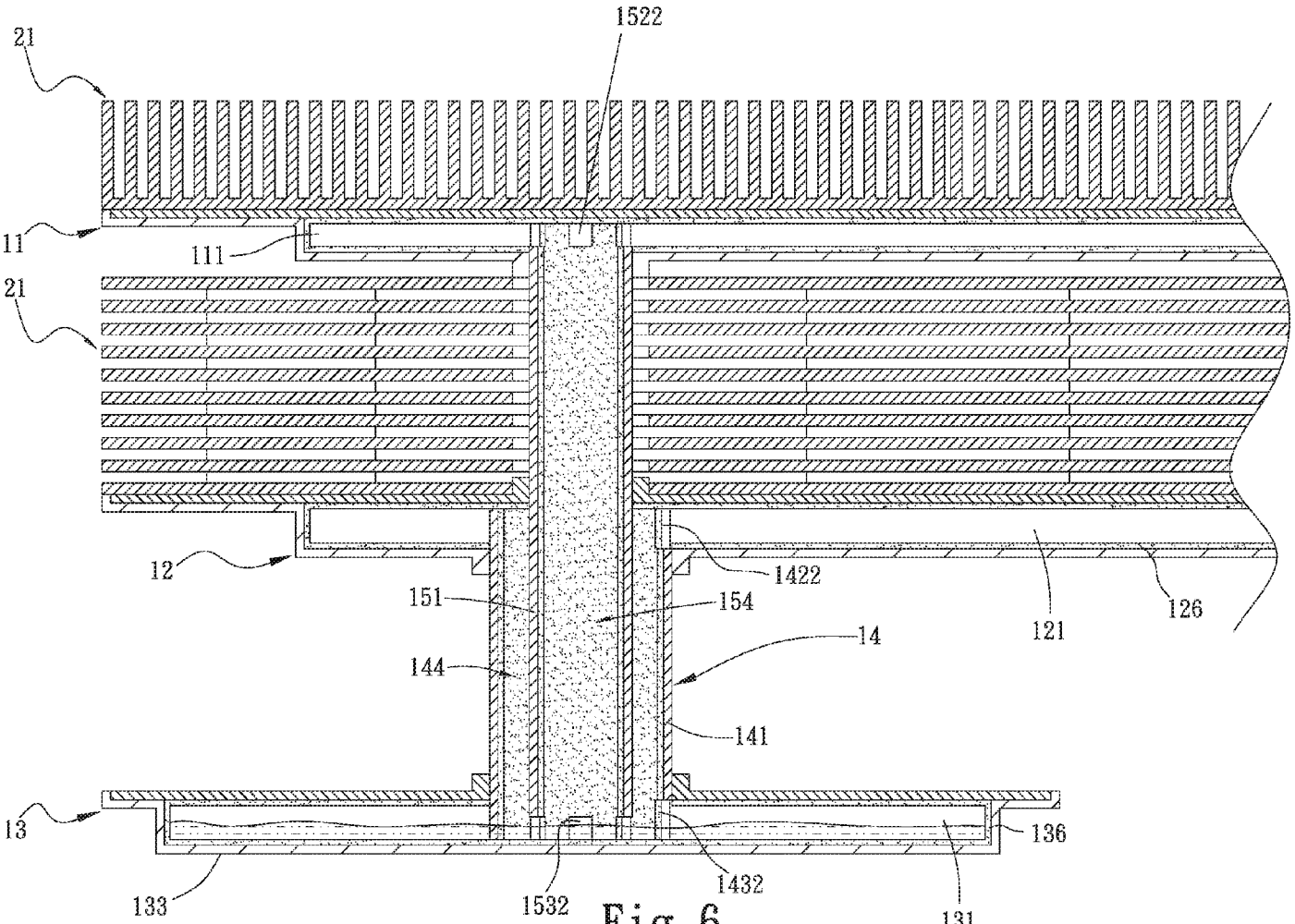
FIG. 6 is a sectional view of still another aspect of the first embodiment of the present invention.

Please further refer to FIG. 6. A heat dissipation unit, such as a heat sink 21, a fan or an assembly of the heat sink 21 and the fan, is selectively disposed on the first and second outer top face 112, 122 of the first and second cases 11, 12.

In a preferred embodiment, there is a heat sink 21 having multiple radiating fins for enlarging the area in contact with the air. Accordingly, the heat of the first and second outer top faces 112, 122 can be quickly dissipated through the heat sink 21.

According to the above arrangement, the working fluid 135 in multiple third cases 13 can respectively flow through the connected first heat pipes 14 to the second case 12 and flow through the connected second heat pipes 15 to the first case 11. Then, the heat is dissipated from the first outer top face 112 of the first case 11 and the second outer top face 122 of the second case 12. Finally, via the gravity and the capillary attraction, the liquid working fluid 135 will flow from the first case 11 through the second heat pipes 15 back into the third cases 13 and flow from the second case 12 through the first heat pipes 14 back into the third cases 13. Due to the double effects of the gravity and the capillary attraction, the backflow rate of the working fluid 135 is increased and the vapor-liquid circulation efficiency is enhanced so that the heat dissipation efficiency is increased. On the other hand, the heat dissipation area of the first and second outer top faces 112, 122 is larger than the heat absorption area of the third outer bottom face 133 of any third case 13 or the total of the heat absorption areas of the third cases 13. Therefore, after the working fluid 135 of the third cases 13 respectively flows to the first and second cases 11, 12 and collects, the heat is dissipated from the large heat dissipation area of the first and second cases 11, 12 to enhance the heat exchange efficiency.

Figure 7:
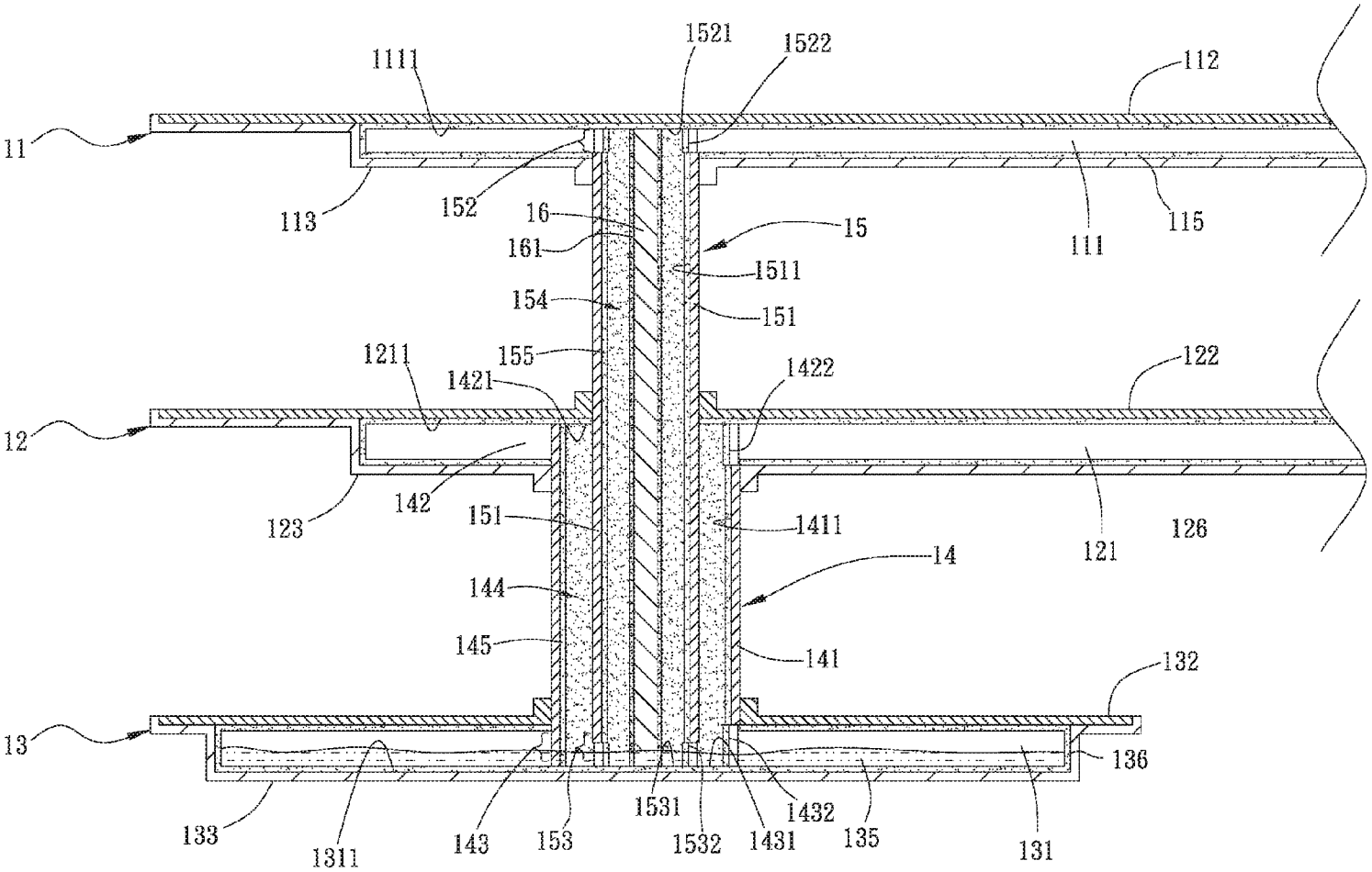
FIG. 7 is a partially sectional view of a second embodiment of the present invention.

Please refer to FIG. 7, which is a partially sectional view of a second embodiment of the present invention. The second embodiment is substantially identical to the first embodiment in structure, connection relationship and effect and thus will not be repeatedly described hereinafter. The second embodiment is different from the first embodiment in that each second heat pipe 15 further has at least one support body 16. The support body 16 is disposed in the second heat pipe passage 154. One end of the support body 16 abuts against the inner top side 1111 of the first case chamber 111. The other end of the support body 16 abuts against the inner bottom side 1311 of the third case chamber 131. The two ends of the second heat pipe 15 respectively abut against the inner top side 1111 of the first case 11 and the inner bottom side 1311 of the third case 13 to support the first case chamber 111. Also, the support body 16 serves to support the first case chamber 111. Therefore, double support effects are achieved to effectively enhance the support strength.

In addition, a capillary structure 161 is disposed on the support body 16. In this embodiment, the support body 16 is a metal column (such as a copper column). The capillary structure 161 is formed on the outer circumference of the metal column. The capillary structure 161 is selected from a group consisting of sintered metal powder body, mesh woven body, grooved body and a combination thereof. The capillary structure 161 of the support body 16 is in connection and contact with the first case capillary structure 115 and the third case capillary structure 136. Accordingly, the liquid working fluid 135 on the first case capillary structure 115 not only can flow back into the third case chamber 131 via the capillary attraction of the second heat pipe capillary structure 155 and gravity, but also can flow back into the third case chamber 131 via the capillary attraction of the sintered powder body on the outer circumferential surface of the support body and gravity. In this case, the backflow rate of the liquid working fluid 135 can be effectively increased. In practice, the support body 16 is not limited to the above metal column. Alternatively, the support body 16 can be a support body formed by means of powder metallurgy sintering.

Figure 8A:
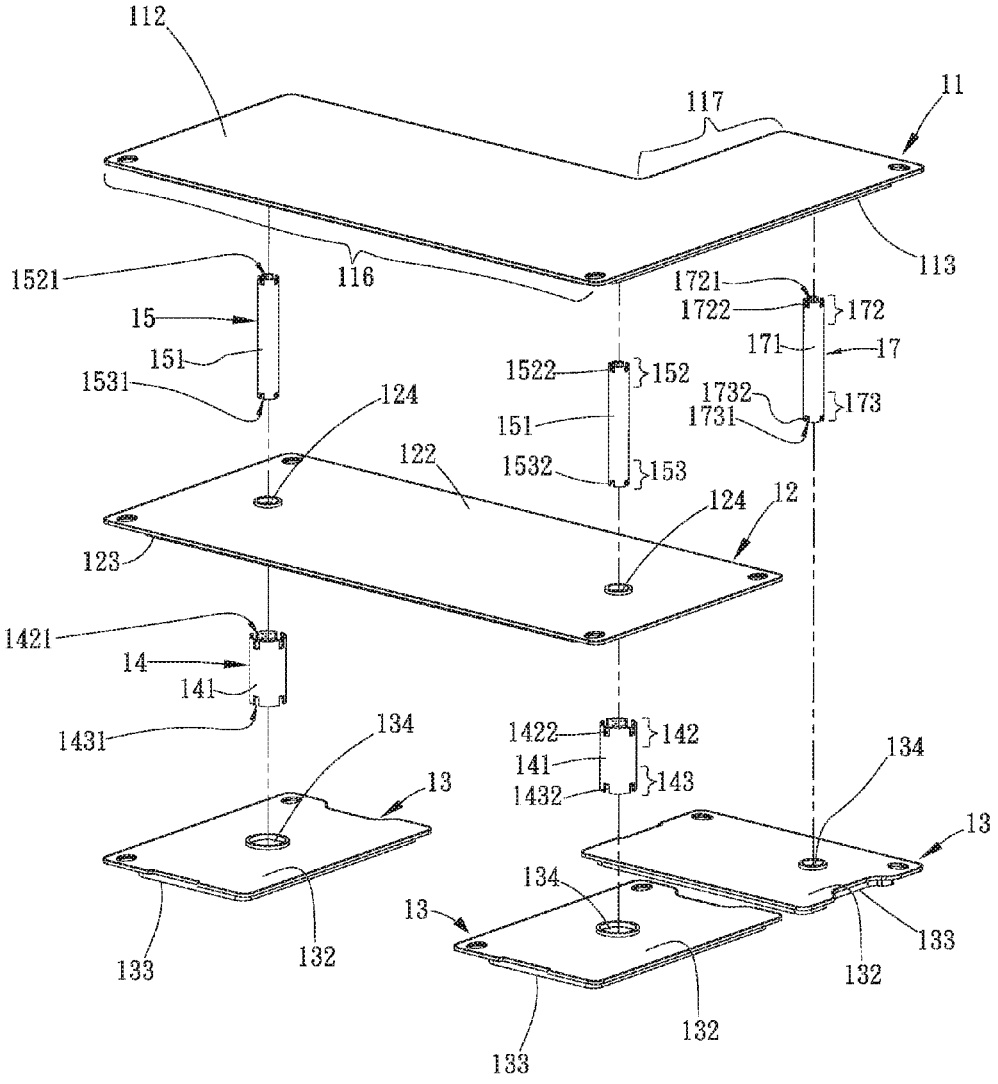
FIG. 8A is a perspective exploded view of a third embodiment of the present invention.
Figure 8B:
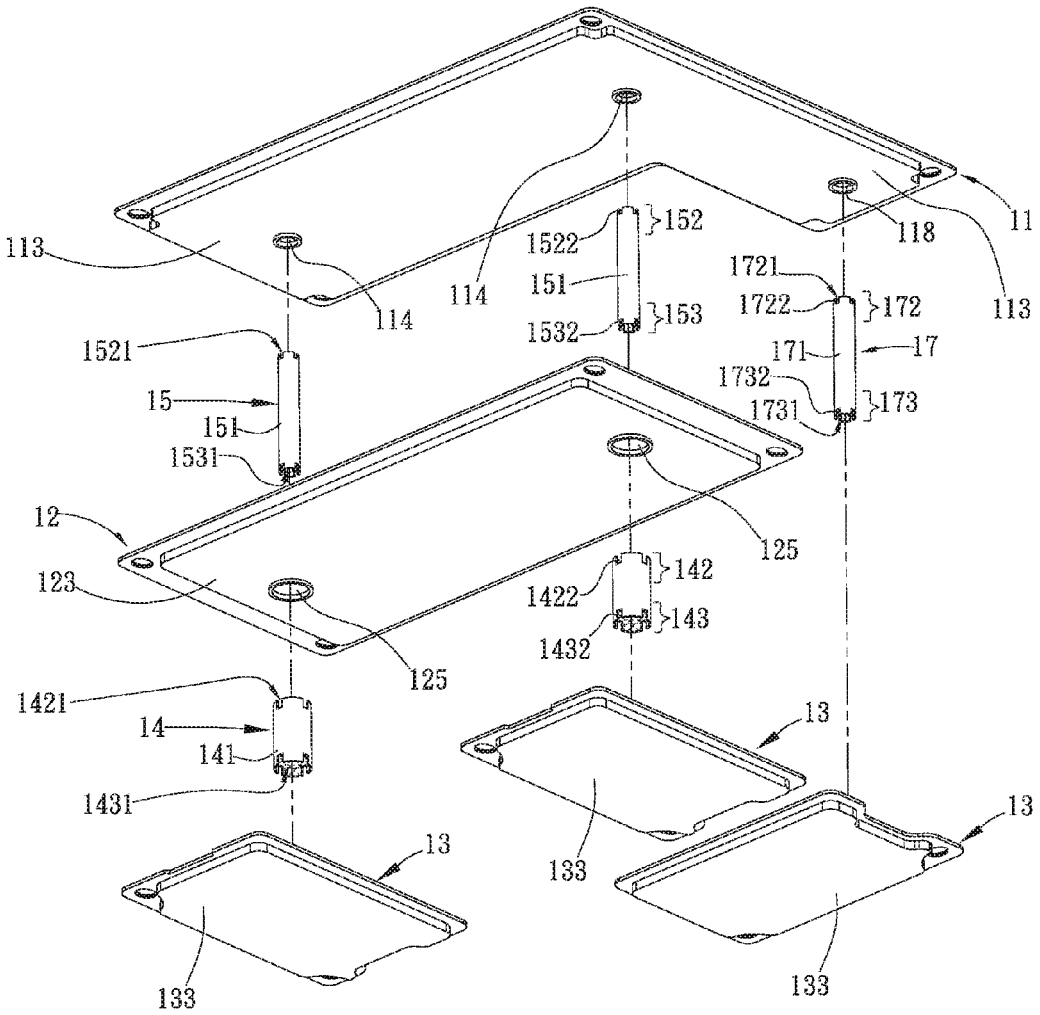
FIG. 8B is a perspective exploded view of the third embodiment of the present invention, seen from another angle.
Figure 9A:
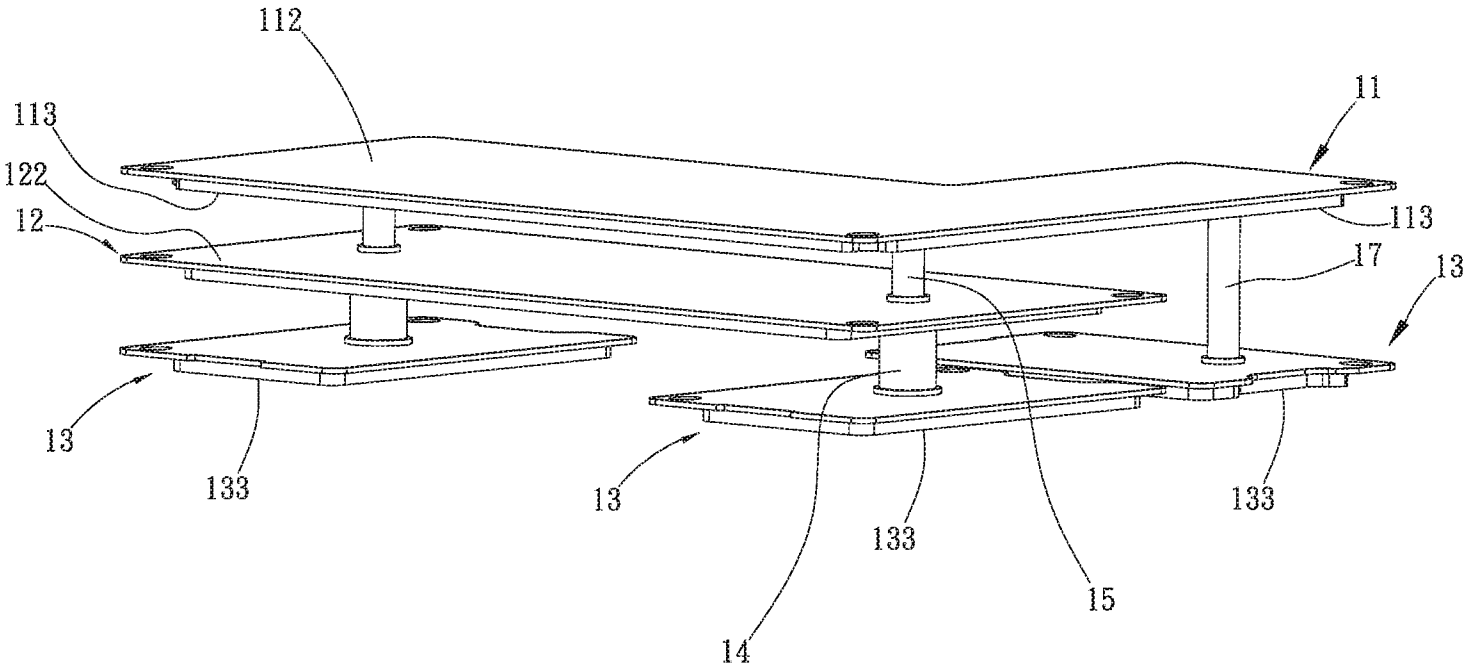
FIG. 9A is a perspective assembled view of the third embodiment of the present invention.

Please refer to FIGS. 8A and 9A. FIG. 8A is a perspective exploded view of a third embodiment of the present invention. FIG. 9A is a perspective assembled view of the third embodiment of the present invention. Also, please supplementally refer to FIGS. 8B and 9B. The third embodiment is substantially identical to the first embodiment in structure, connection relationship and effect and thus will not be repeatedly described hereinafter. The third embodiment is different from the first embodiment in that the first case 11 has a first section 116 and at least one second section 117 integrally outward extending from at least one side of the first section 116. The first section 116 of the first case 11 is positioned right above the second case 12. The first and section sections 116, 117 of the first case 11 together define the first case chamber 111. In this embodiment, the second section 117 horizontally outward extends from one side of the first section 116 in a direction away from the first section 116 to form an L-shaped first case 11. In a modified embodiment, there are multiple second sections 117 such as two second sections 117 outward extending from the same side of the first section 116 in the same direction to form a U-shaped first case 11. Alternatively, there are two second sections 117 outward extending from two opposite sides of the first section 116 in different directions to form a substantially Z-shaped first case 11. Still alternatively, the first case 11 can have any other geometrical shape.

In this embodiment, the aforesaid two first perforations 114 are formed through the first outer bottom face 113 of the first section 116 of the first case 11 in communication with the first case chamber 111. The second section 117 is formed with at least one fifth perforation 118. The fifth perforation 118 is formed through the first outer bottom face 113 of the second section 117 of the first case 11 in communication with the first case chamber 111. In this embodiment, there are three third cases 13. Two of the three third cases 13 are positioned right below the second case 12. The last third case 13 is positioned below the second section 117 of the first case 11.

Figure 9B:
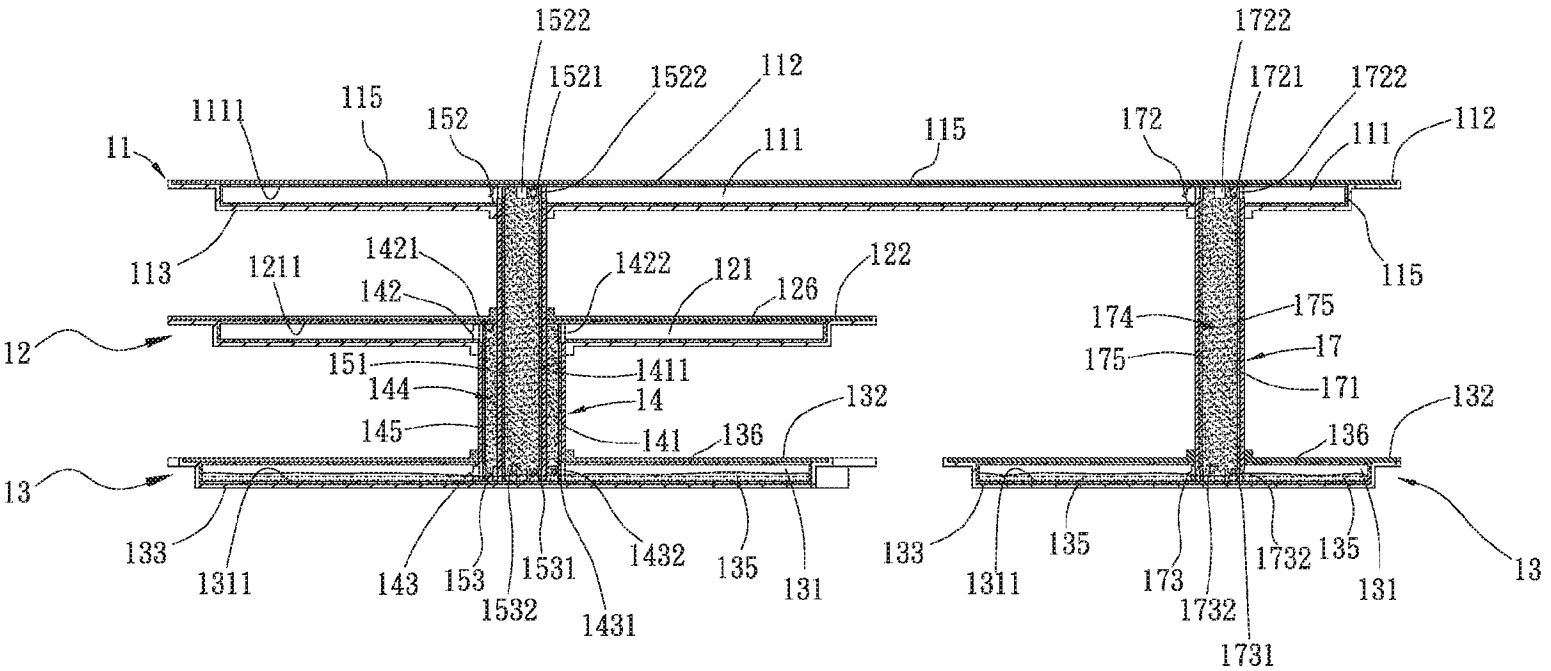
FIG. 9B is a partially sectional view of the third embodiment of the present invention.

In addition, the integrated heat dissipation device further includes at least one third heat pipe 17. The third heat pipe 17 has a third tubular wall 171, a fifth extension section 172 forming a fifth open end 1721 and a sixth extension section 173 forming a sixth open end 1731. The third tubular wall 171 has an internal third heat pipe passage 174. A third heat pipe capillary structure 175 is disposed in the third heat pipe passage 174 between the fifth open end 1721 and the sixth open end 1731. The fifth and sixth open ends 1721, 1731 are respectively positioned at two ends (the front end and rear end) of the third heat pipe 17. The two ends of the third heat pipe 17 are respectively inserted in the corresponding fifth perforation 118 of the first case 11 and the corresponding fourth perforation 134 of one of the third cases 13, (that is, the last third case 13). In other words, as shown in FIG. 9B, the fifth extension section 172 of the third heat pipe 17 extends through the corresponding fifth perforation 118 into the first case chamber 111, whereby the fifth open end 1721 abuts against an inner top side 1111 of the first case chamber 111. Moreover, the third heat pipe capillary structure 175 of the fifth open end 1721 is in connection and contact with the first case capillary structure 115 on the inner top side 1111 in the first case chamber 111.

Moreover, the sixth extension section 173 of the third heat pipe 17 extends through the corresponding fourth perforation 134 of the third case 13, (that is, the last third case 13)

into the third case chamber 131, whereby the sixth open end 1731 abuts against the inner bottom side 1311 of the third case chamber 131. Moreover, the third heat pipe capillary structure 175 of the sixth open end 1731 is in connection and contact with the third case capillary structure 136 on the inner bottom side 1311 in the third case chamber 131. The fifth and sixth extension sections 172, 173 of the third heat pipe 17 are respectively formed with fifth notches 1722 and sixth notches 1732 passing through the third tubular wall 171. The third heat pipe passage 174 communicates with the first case chamber 111 and the third case chamber 131 via the fifth and sixth notches 1722, 1732.

The third heat pipe capillary structure 175 is selected from a group consisting of sintered metal powder body, mesh woven body, grooved body and bundled fiber body. The third heat pipe capillary structure is a porous structure capable of providing capillary attraction for driving the working fluid 135 to flow.

Accordingly, when the third outer bottom face 133 of the third case 13, (that is, the last third case 13), is in contact with a heat source (such as a CPU, an MCU, a GPU or any other electronic component), the heat of the heat source is transferred through the third outer bottom face 133 into the third case chamber 131. The working fluid 135 in the third case chamber 131 absorbs the heat and converts/evaporates into vapor working fluid 135. The vapor working fluid 135 will flow through the third heat pipe passage 174 and flow from the fifth notches 1722 into the first case chamber 111. The vapor working fluid 135 will condense and convert into liquid working fluid in the first case chamber 111. Then, the liquid working fluid on the first case capillary structure 115 in the first case chamber 111 will flow back to the sixth open end 1731 via the capillary attraction of the third heat pipe capillary structure 175 of the fifth open end 1721 and gravity. Then, due to the connection and contact between the third heat pipe capillary structure 175 and the third case capillary structure 136, the liquid working fluid will flow back into the third case chamber 131 to continue the vapor-liquid circulation and achieve best heat dissipation efficiency.

According to the above arrangement, the second section 117 of the first case 11 integrally outward extends from at least one side of the first section 116. Therefore, according to the number and different positions of multiple heat sources, the integrally outward extending length and direction of the second section 117 from the first section 116 can be previously adjusted. In this case, the application of the integrated heat dissipation device is more convenient and diversified.

Figure 10A:
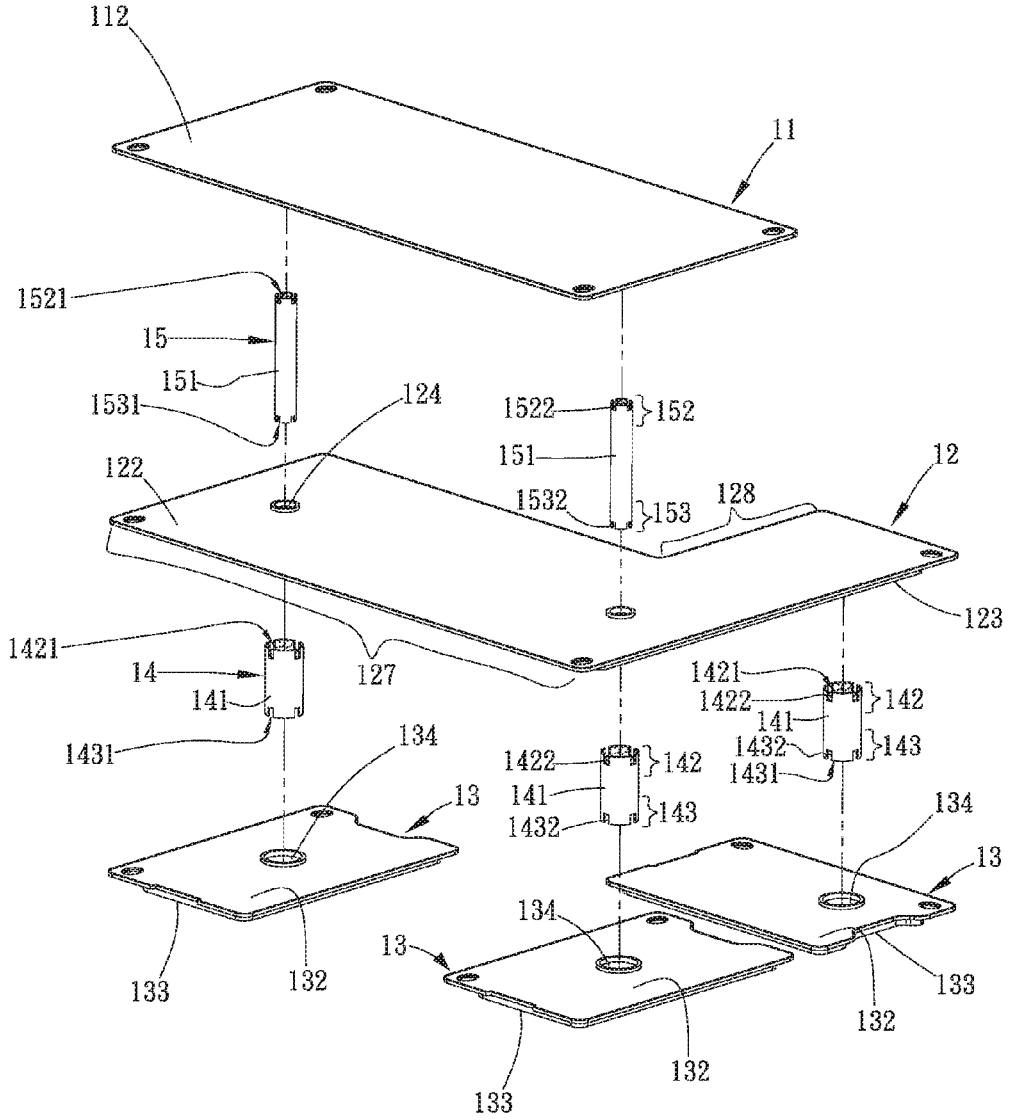
FIG. 10A is a perspective exploded view of a fourth embodiment of the present invention.
Figure 10B:
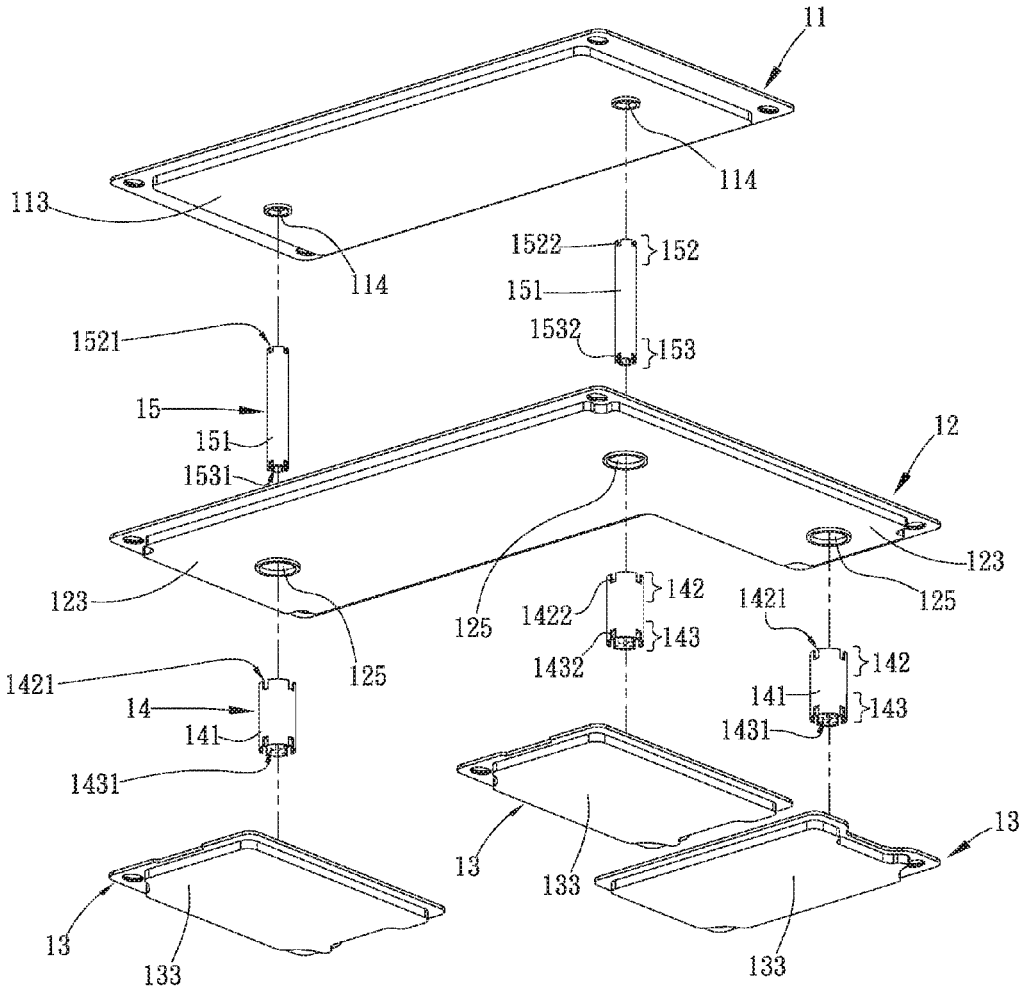
FIG. 10B is a perspective exploded view of the fourth embodiment of the present invention, seen from another angle.
Figure 11A:
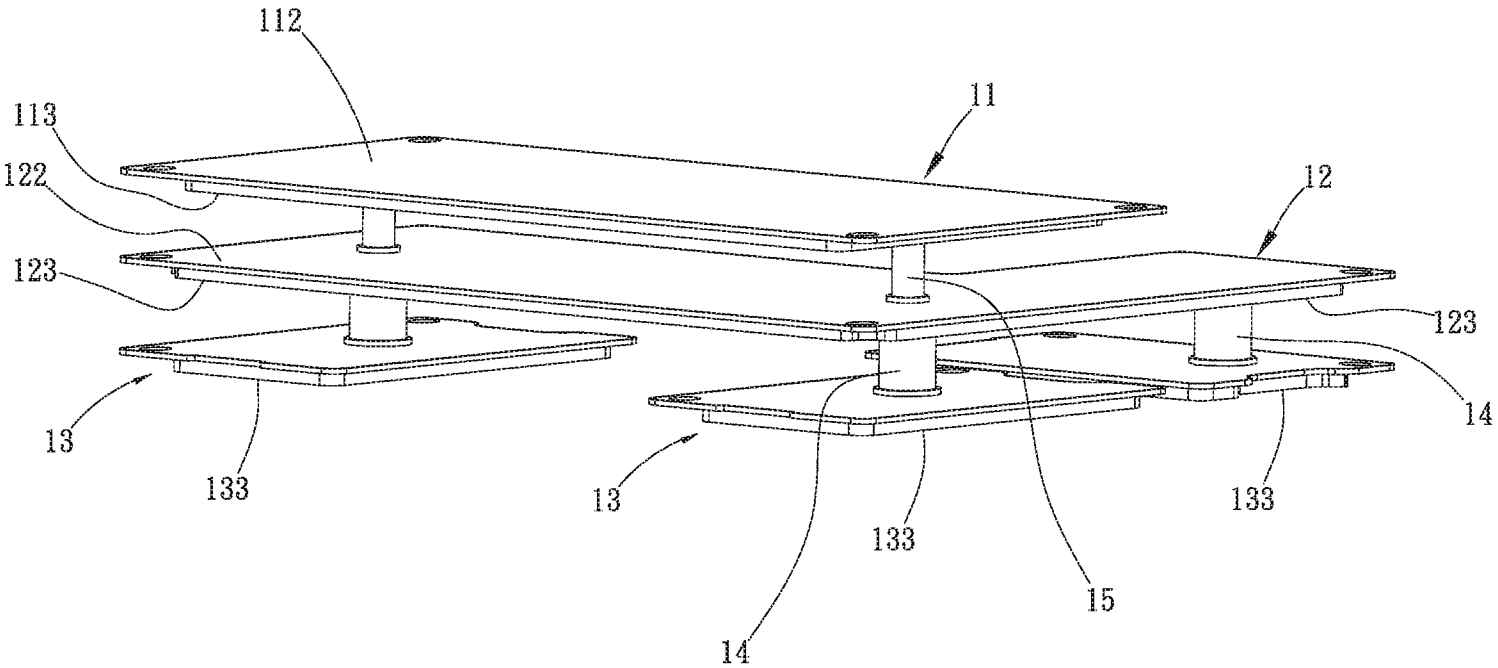
FIG. 11A is a perspective assembled view of the fourth embodiment of the present invention.
Figure 11B:
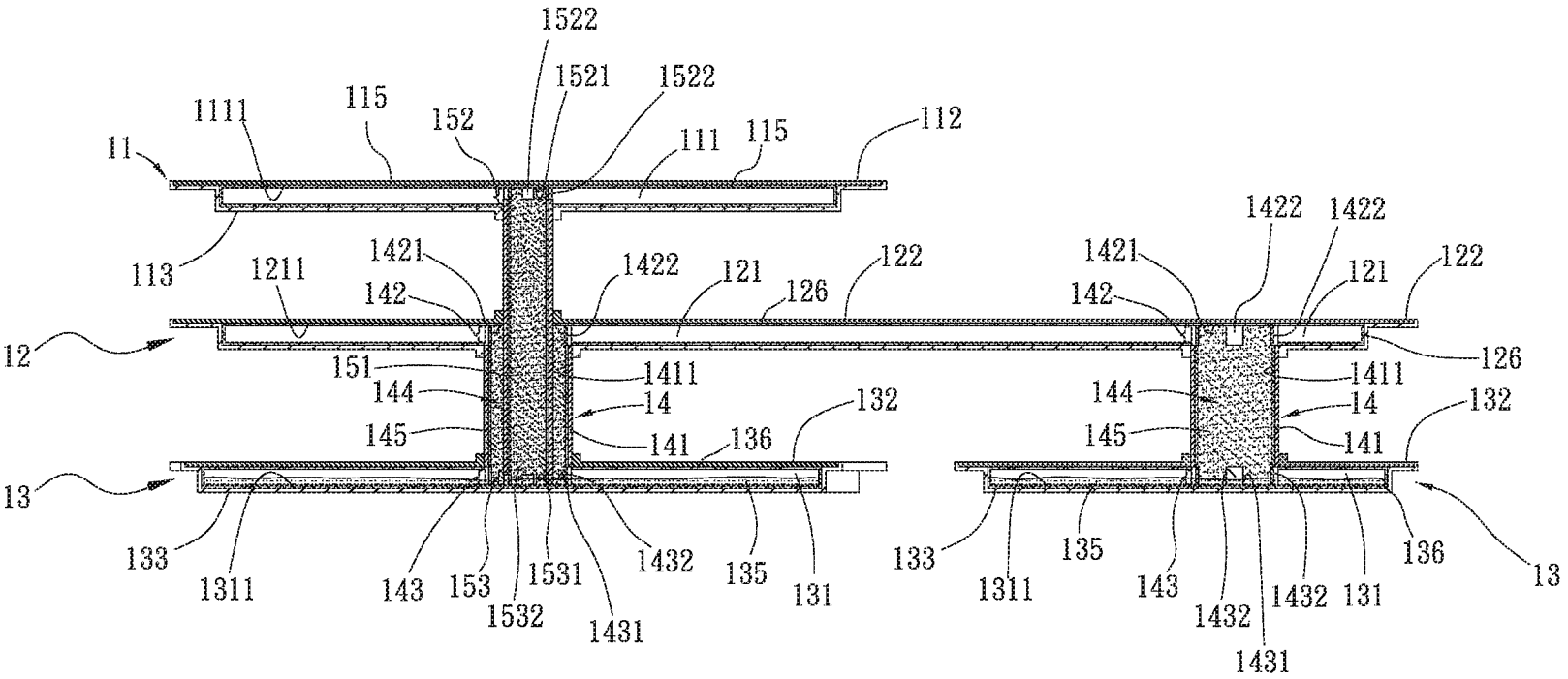
FIG. 11B is a partially sectional view of the fourth embodiment of the present invention.

Please refer to FIGS. 10A and 11A. FIG. 10A is a perspective exploded view of a fourth embodiment of the present invention. FIG. 11A is a perspective assembled view of the fourth embodiment of the present invention. Also, please supplementally refer to FIGS. 10B and 11B. The fourth embodiment is substantially identical to the first embodiment in structure, connection relationship and effect and thus will not be repeatedly described hereinafter. The fourth embodiment is different from the first embodiment in that the second case 12 has a first section 127 and at least one second section 128 integrally outward extending from at least one side of the first section 127. The first section 127 of the second case 12 is positioned below the first case 11. The first and section sections 127, 128 of the second case 12 together define the second case chamber 121. In this embodiment, the second section 128 horizontally outward extends from one side of the first section 127 in a direction away from the first section 127 to form an L-shaped second case 12. In a modified embodiment, there are multiple second sections 128 such as two second sections 128 outward extending from the same side of the first section 127 in the same direction to form a U-shaped second case 12. Alternatively, there are two second sections 128 outward extending from two opposite sides of the first section 127 in different directions to form a substantially Z-shaped second case 12. Still alternatively, the second case 12 can have any other shape.

In this embodiment, the aforesaid two third perforations 125 are formed through the second outer bottom face 123 of the first section 127 of the second case 12 in communication with the second case chamber 121. Another third perforation 125 is formed on the second section 128 of the second case 12. In this embodiment, there are three third cases 13. Two of the three third cases 13 are positioned right below the first section 127 of the second case 12. The last third case 13 is positioned below the second section 128 of the second case 12. In addition, in this embodiment, there are three first heat pipes 14. Two ends (the first and second open ends 1421, 1431) of two of the three first heat pipe 14 are respectively inserted in the two corresponding third perforations 125 of the first section 127 of the second case 12 and the corresponding fourth perforations 134 of the two third cases 13. Two ends of the other first heat pipe 14 are respectively inserted in the corresponding third perforation 125 of the second section 128 of the second case 12 and the corresponding fourth perforation 134 of the third case 13 (the last third case 13). Moreover, the first heat pipe capillary structure 145 of the other first heat pipe 14 is in connection with the corresponding second case capillary structure 126 in the second section 128 of the second case 12 and the corresponding third case capillary structure 136 of the third case 13 (the last third case 13).

According to the above arrangement, the second section 128 of the second case 12 integrally outward extends from at least one side of the first section 127. Therefore, according to the number and different positions of multiple heat sources, the integrally outward extending length and direction of the second section 128 from the first section 127 can be previously adjusted. In this case, the application of the integrated heat dissipation device is more convenient and diversified.

The present invention has been described with the above embodiments thereof and it is understood that many changes and modifications in the above embodiments can be carried out without departing from the scope and the spirit of the invention that is intended to be limited only by the appended claims.

What is claimed is:

1. An integrated heat dissipation device comprising:

at least one first case defining a first case chamber, the first case having at least one first perforation in communication with the first case chamber, a first case capillary structure being disposed in the first case chamber, the first case chamber having an inner top side spaced from and opposite to the first perforation;

a second case disposed below the at least one first case and defining a second case chamber, the second case having at least one second perforation and multiple third perforations in communication with the second case chamber, a second case capillary structure being disposed in the second case chamber;

multiple third cases disposed below the second case, each of the third cases defining a third case chamber, the third case having at least one fourth perforation in communication with the third case chamber, a working fluid being contained in the third case chamber, a third case capillary structure being disposed in the third case chamber, the third case chamber having an inner bottom side spaced from and opposite to the fourth perforation;

multiple first heat pipes, each first heat pipe having a first heat pipe passage, two ends of the first heat pipe being respectively inserted in the corresponding third and fourth perforations, the first heat pipe passage communicating with the second and third case chambers, a first heat pipe capillary structure being disposed in the first heat pipe passage in connection with the second and third case capillary structures;

at least one second heat pipes, the second heat pipe having a second heat pipe passage, one end of the second heat pipe being inserted in the corresponding first perforation, the other end of the second heat pipe being passed through the first heat pipe passage and the corresponding second perforation into the corresponding third case chamber, the second heat pipe passage communicating with the first case chamber and the corresponding third case chamber, a second heat pipe capillary structure being disposed in the second heat pipe passage in connection with the first case capillary structure and the corresponding third case capillary structure, wherein each first heat pipe is concentrically mounted on an outside of the at least one second heat pipes, respectively, and wherein the first heat pipe passage surrounds a part of the at least one second heat pipes; and a working fluid in the third case chamber configured to flow through the first heat pipe passage to the second case chamber and from the second case chamber through the first heat pipe passage back into the third case chamber via gravity and capillary attraction so as to define a first vapor liquid circulation and the working fluid in the third case chamber further configured to flow through the second heat pipe passage to the first case chamber and from the first case chamber through the second heat pipe passage back into the third case chamber via gravity and capillary attraction so as to define a second vapor liquid circulation.

2. The integrated heat dissipation device as claimed in claim 1, wherein the first case has a first outer top face defining a heat dissipation area and the second case has a second outer top face defining a heat dissipation area, each third case having a third outer bottom face defining a heat absorption area, the heat dissipation area of the first case being larger than or equal to the heat absorption area of any third case, the heat dissipation area of the second case being larger than the heat absorption area of any third case.

3. The integrated heat dissipation device as claimed in claim 1, wherein the first heat pipe has a first tubular wall, a first extension section forming a first open end and a second extension section forming a second open end, the first tubular wall defining the first heat pipe passage, the first heat pipe capillary structure being disposed in the first tubular wall between the first open end and the second open end.

4. The integrated heat dissipation device as claimed in claim 3, wherein the second heat pipe has a second tubular wall, a third extension section forming a first open end and a fourth extension section forming a fourth open end, the second tubular wall defining the second heat pipe passage, the second heat pipe capillary structure being disposed in the second tubular wall between the third open end and the fourth open end.

5. The integrated heat dissipation device as claimed in claim 3, wherein the first extension section extends through the corresponding third perforation into the second case chamber and the first open end abuts against an inner top side of the second case chamber, the second extension section extending through the corresponding fourth perforation into the third case chamber and the second open end abutting against the inner bottom side of the third case chamber.

6. The integrated heat dissipation device as claimed in claim 4, wherein the third extension section extends through the corresponding first perforation into the first case chamber and the third open end abuts against the inner top side of the first case chamber, the fourth extension section extending through the corresponding second perforation and the first heat pipe passage into the third case chamber and the fourth open end abutting against the inner bottom side of the third case chamber.

7. The integrated heat dissipation device as claimed in claim 5, wherein the first heat pipe capillary structure is in connection with the second and third case capillary structures through the first and second open ends.

8. The integrated heat dissipation device as claimed in claim 6, wherein the second heat pipe capillary structure is in connection with the first and third case capillary structures through the third and fourth open ends.

9. The integrated heat dissipation device as claimed in claim 7, wherein the first and second extension sections are respectively formed with a first notch and a second notch passing through the first tubular wall, the first heat pipe passage communicating with the second case chamber and the third case chamber through the first and second notches.

10. The integrated heat dissipation device as claimed in claim 8, wherein the third and fourth extension sections are respectively formed with a third notch and a fourth notch passing through the second tubular wall, the second heat pipe passage communicating with the first case chamber and the third case chamber through the third and fourth notches.

11. The integrated heat dissipation device as claimed in claim 9, wherein the first tubular wall has a first inner surface facing the first heat pipe passage, the first heat pipe capillary structure being formed on the first inner surface, the first inner surface being formed with multiple first ribs arranged at intervals, each two adjacent first ribs defining therebetween a first channel, the first ribs and the first channels being alternately arranged and extending in a lengthwise direction of the first heat pipe.

12. The integrated heat dissipation device as claimed in claim 10, wherein the second tubular wall has a second inner surface facing the second heat pipe passage, the second heat pipe capillary structure being formed on the second inner surface, the second inner surface being formed with multiple second ribs arranged at intervals, each two adjacent second ribs defining therebetween a second channel, the second ribs and the second channels being alternately arranged and extending in a lengthwise direction of the second heat pipe.

13. The integrated heat dissipation device as claimed in claim 1, wherein the first, second and third cases are vapor chambers or flat-plate heat pipes.

14. The integrated heat dissipation device as claimed in claim 1, wherein each first heat pipe has a diameter, the diameter of the first heat pipe being larger than the diameter of the second heat pipe.

15. The integrated heat dissipation device as claimed in claim 3, wherein each second heat pipe further has at least one support body, the support body being disposed in the second heat pipe passage, one end of the support body abutting against the inner top side of the first case chamber, the other end of the support body abutting against the inner bottom side of the third case chamber.

16. The integrated heat dissipation device as claimed in claim 15, wherein a capillary structure is disposed on the support body, the capillary structure being formed on an outer circumference of the support body.

17. The integrated heat dissipation device as claimed in claim 1, wherein the first case has a first section and at least one second section integrally outward extending from at least one side of the first section, the first perforation being formed on the first section of the first case, at least one fifth perforation being formed on the second section, two ends of at least one third heat pipe being respectively inserted in the corresponding fifth perforation and the corresponding fourth perforation of one of the third cases.

18. The integrated heat dissipation device as claimed in claim 1, wherein the second case has a first section and at least one second section integrally outward extending from at least one side of the first section, at least two third perforations being formed on the first section of the second case, at least one third perforation being formed on the second section of the second case, two ends of at least one first heat pipe being respectively inserted in the corresponding at least one third perforation and the corresponding fourth perforation of at least one third case, the first heat pipe capillary structure of the at least one first heat pipe being in connection with the corresponding second case capillary structure in the second section of the second case and the corresponding third case capillary structure of the at least one third case.

19. The integrated heat dissipation device as claimed in claim 2, wherein the first, second and third cases are vapor chambers or flat-plate heat pipes.

20. The integrated heat dissipation device as claimed in claim 3, wherein the first, second and third cases are vapor chambers or flat-plate heat pipes.

* * * * *